United States Patent [19]

Palmer, Jr.

[11] Patent Number: 4,762,078

[45] Date of Patent: Aug. 9, 1988

[54] INFLATABLE AQUATIC VESSELS

[76] Inventor: John M. Palmer, Jr., P.O. Box 2171, Lutz, Fla. 33549

[21] Appl. No.: 863,610

[22] Filed: May 15, 1986

Related U.S. Application Data

[63] Continuation-in-part of Ser. No. 738,212, May 8, 1985, abandoned.

[51] Int. Cl.[4] ..... B63B 7/08

[52] U.S. Cl. ..... 114/39.1; 114/56; 114/61; 114/345; 114/357

[58] Field of Search ..... 114/39, 61, 123, 56, 114/57, 230, 345, 357; 441/35, 40, 45, 47

[56] References Cited

U.S. PATENT DOCUMENTS

| | | | |
|---|---|---|---|
| 12,143 | 1/1855 | Tucker | 114/61 |
| 1,715,312 | 5/1929 | Steele | 114/61 |
| 3,593,684 | 7/1971 | Cogliano | 114/61 |
| 3,785,317 | 1/1974 | Currey | 114/61 |
| 3,863,591 | 2/1975 | Wild | 114/230 |
| 4,136,414 | 1/1979 | Popkin | 114/61 |
| 4,286,534 | 9/1981 | Sanner | 114/61 |
| 4,348,971 | 9/1982 | Montgomery | 114/61 |
| 4,440,103 | 4/1984 | Lang | 114/61 |
| 4,498,413 | 2/1985 | Cochran | 114/345 |
| 4,534,738 | 8/1985 | McKnight | 114/61 |

FOREIGN PATENT DOCUMENTS

| | | | |
|---|---|---|---|
| 2907518 | 9/1980 | Fed. Rep. of Germany | 114/61 |

*Primary Examiner*—Joseph F. Peters, Jr.
*Assistant Examiner*—Stephen P. Avila
*Attorney, Agent, or Firm*—Charles A. McClure

[57] ABSTRACT

Aquatic vessels having inflatable hull envelopes that receive transversely (i.e., are transected by) tie members for carrying framework upon which decking, propulsion devices, etc. are supported. The hull envelopes, which are generally cigar-shaped, are located side by side, with or without spacing of adjacent envelopes apart. Engine-propulsion and/or wind-propulsion devices can be supported on the framework, with or without adaptation of the envelopes thereto. Such vessels are useful for general transportation or for special recreational uses such as carrying persons for deep-sea fishing, or pulling persons on water skies along the surface, or persons held aloft by a parachute-like sail (or "parasail") above the surface, and are capable of high-speed travel.

10 Claims, 7 Drawing Sheets

INFLATABLE AQUATIC VESSELS

BACKGROUND OF THE INVENTION

This is a continuation-in-part of my copending application, Ser. No. 738,212 filed 28 May 1985 now abandoned, which is incorporated herein in its entirety by this reference.

This invention relates to assembly, structure, and use of aquatic vessels having hull members including inflatable envelopes.

Inflatables have been known as means of amusement, transport, and otherwise for many years. Frequently they have been attached to one another and to other items, as by lashing them together, which is awkward and often risky. Alternatively, or additionally, inflatables are adhered or bonded together, directly or through intermediate devices to which they have been attached similarly. And even when some such interconnection has been successful the resulting structure may be so badly stressed as to be unsafe, or be so difficult to assemble and disassemble as to be impractical.

The flexibility of inflatable hull members complicates their lateral interconnection. Popkin U.S. Pat. No. 4,136,414 discloses transverse connecting members (as well as longitudinal reinforcing members) retained frictionally in sleeves formed at the exterior of the hull envelopes and retained in place by hull compression against the sleeves. More complex connectors are also known.

Rigid hull members may be aligned side-by-side by means of transverse spars extending from one hull member to fastening means on (or even into an opening in) another such hull member. However, the strengths of the rigid materials used, and the distribution of stresses in rigid bodies, are so different from the conditions in inflatables that what is applicable to rigid hulls is normally totally out of place in inflatables. Therefore, persons skilled in making rigid hull vessels are unlikely to undertake to make vessels with inflatable hulls or, if they should do so, are unlikely to try to use with inflatables their methods for working with rigid hulls.

Similarly, aquatic vessels with inflatable hull members are subject to such constraints that persons skilled in making or using them know enough to avoid conventional rigid hull techniques in so doing—and also know not to attempt high-speed propulsion of them.

My invention is directed to bringing boats or other aquatic vessels with inflatable hull members to structural and operational levels not hitherto attempted or attained.

SUMMARY OF THE INVENTION

In general, the objects of this invention are accomplished, in an aquatic vessel having at least one exposed inflatable hull member, by tie means transecting the hull, and framework including means interconnecting to and supported by the tie means. Preferably a plurality of such inflatable hull members are so interconnected and thereby distribute the burden of supporting the framework, which supports decking, propulsion means, superstructure, etc.

A primary object of the present invention is provision of inflatables with means for assembling or interconnecting them to turn their inflatability and related flexing characteristics from an actual or potential disadvantage into a benefit.

Another object of this invention is assembly of portable inflatable envelopes, as modules, into much larger structures that are either portable only with great difficulty, or not at all, when assembled—but that can be readily disassembled.

A further object of the invention is equipping of aquatic vessels having inflatable hull members for high-speed travel.

Yet another object is provision of structural means adapted to facilitating the foregoing in a safe and secure manner.

A still further object is provision of aquatic vessels with novel structural and operational characteristics.

Other objects of the invention, together with means and methods for accomplishing the various objects, will be apparent from the following description and the accompanying diagrams of various embodiments thereof, in a multi-hulled type of vessel, being presented by way of example rather than limitation.

DETAILED DESCRIPTION

Figure 1:
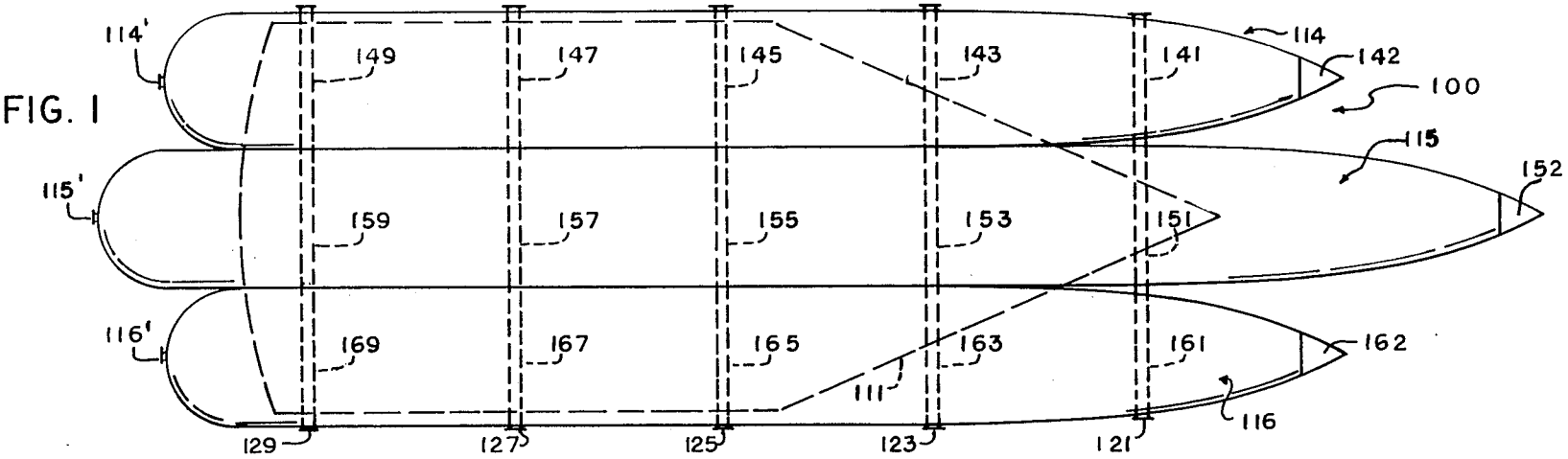
FIG. 1 a top plan view of a first embodiment of hull assembly for an inflatable aquatic vessel according to the present invention.

FIG. 1 shows hull assembly 100 of an aquatic vessel according to this invention in plan (top) comprising a trio of elongated or cigar-like inflatables, here as inflated float or hull envelopes in adjacent parallel arrangement. Each envelope is essentially impervious to both gaseous and liquid fluids and encloses enough air to fill it snugly. At the left, the aft or rear end of each envelope is rounded, whereas the forward or front end of it, at the right, appears pointed (by reason of an added nose cone, detailed later). Long central envelope 115 is flanked by pair of somewhat shorter aligned contiguous envelopes 114 and 116 of like diameter. Filler valves 114', 115', and 116' appear at the aft end, and nose cones 142, 152, and 162 at the forward end, of the hull envelopes.

Extending transversely through (i.e., transecting) assembly 100, as indicated in dashed lines, are aligned sleeves in all the respective float or hull envelopes. Five sets of sleeves appear, with the third set being located approximately amidships, the first and second sets located forward, and the fourth and fifth sets aft. Thus, at the right, forwardmost sleeve 151 of envelope 115 lines up with corresponding sleeve 141 of envelope 114 toward the top of the diagram, at the left or port side of the hull assembly, and with like sleeve 161 of envelope 116 on the opposite or starboard side, toward the bottom of the view. Likewise, sleeves 153, 155, 157, and 159 of envelope 115 are aligned, respectively, with sleeves 143, 145, 147, and 149, and with sleeves 163, 165, 167, and 169. Each sleeve is as impervious as its surrounding envelope and is bonded at its ends to the sidewalls of its envelope, so it seals the interior of the envelope from the exterior.

Visible at the opposite sides of the hull assembly are the ends of tie members 121, 123, 125, 127, and 129—which may be all alike or nearly so. Their ends are protruding from corresponding aligned sleeves, just mentioned, in the inflatable hull members, into which tie members are inserted during assembly and may be removed for disassembly. These tie members are shown in detail in subsequent drawings and are described further below, after description of alternative hull embodiments.

During assembly, the tie members are inserted into appropriate framework (see below), then the hull envelope sleeves are slid thereonto, then or afterward—depending in part on whether within or outside the framework—and are inflated (if not already so) and also are secured thereto. Disassembly is readily accomplished by merely reversing the order of the assembly procedure. The hull envelopes may be transported disinflated or partially or wholly inflated.

Also indicated in FIG. 1, is decking 111, superimposed (in dashed lines) on the hull assembly. The decking is pentagonal in plan, with parallel sides overlapping somewhat more than half of the outermost hull envelopes, tapering to a pointed forward end overlying the transverse bisector (not indicated) of the foremost sleeve, and somewhat convex at the aft end.

Figure 2:
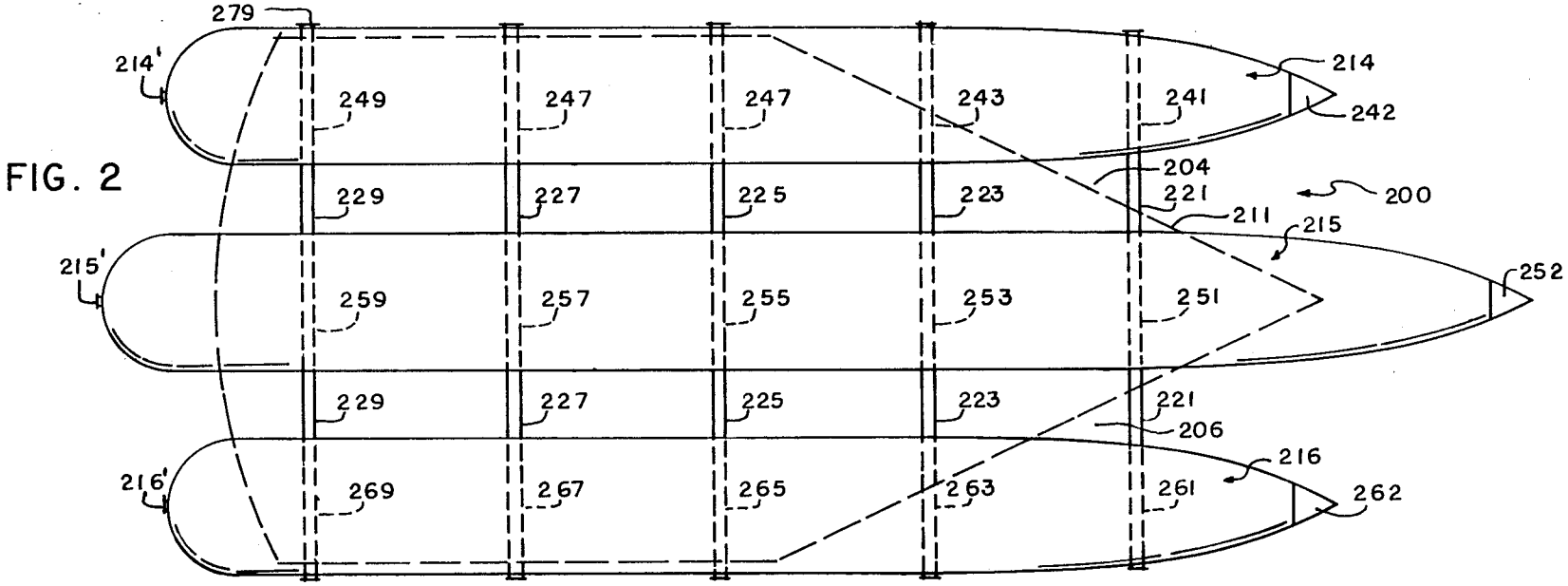
FIG. 2 is a similar plan view of a second embodiment of hull assembly of such a vessel according to this invention.

FIG. 2 shows, in plan, hull assembly 200 of this invention. This second embodiment differs from the first embodiment mainly by having the hull envelopes spaced apart laterally in trimaran fashion. Here and in subsequent diagrams of this embodiment, the reference numbers that designate parts or features corresponding to those in the preceding view are larger by one hundred (i.e., having the same two digits preceded by 2, instead of by 1) and are not necessarily mentioned separately. Thus, central hull envelope 215 is flanked by hull envelopes 214 and 216 and is spaced therefrom by respective longitudinal gaps 204 and 206. The length-to-width ratio is reduced accordingly, and superimposed (dashed) decking 211 is similarly wider and has a less acutely angled forward end.

Figure 3:
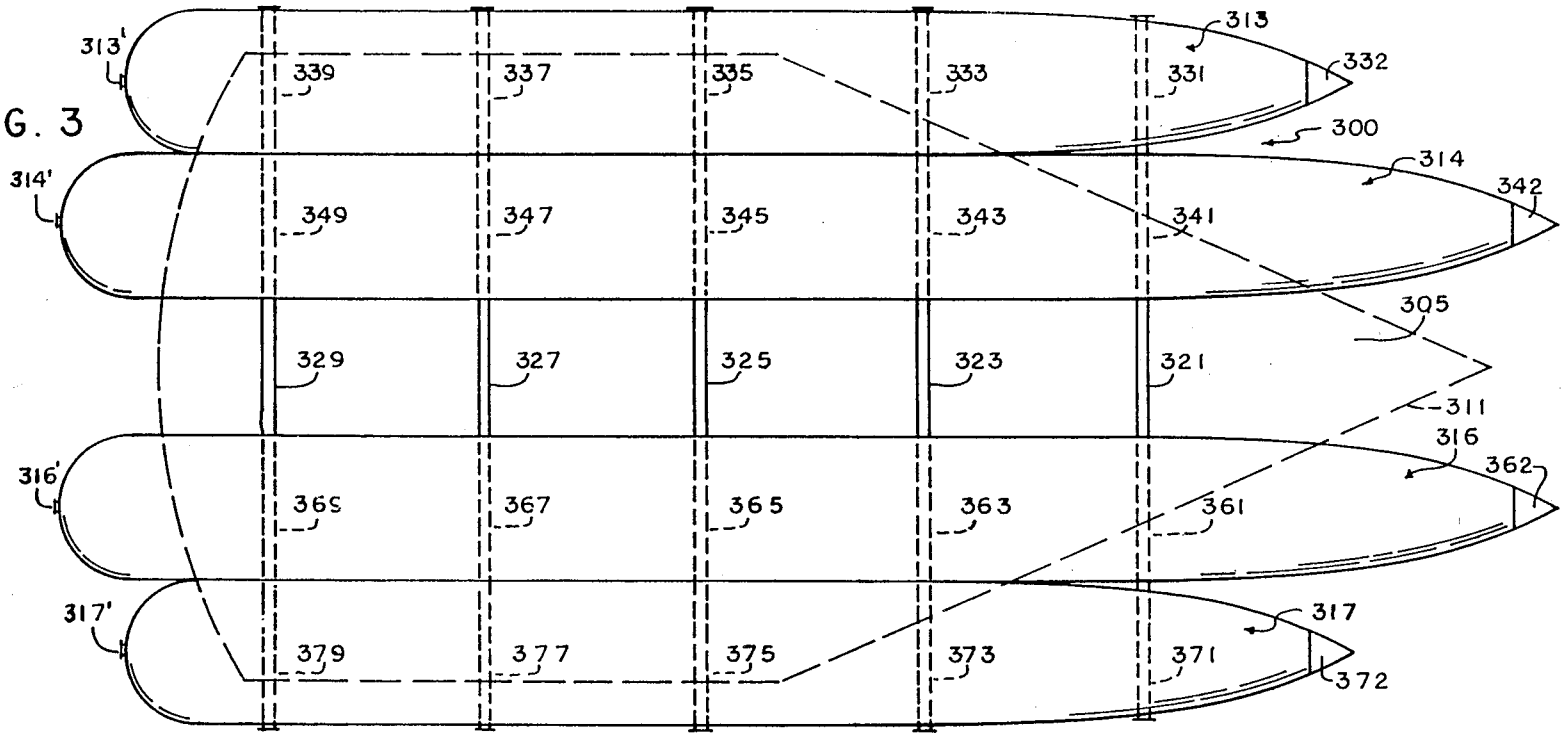
FIG. 3 is a plan of a third hull assembly embodiment according to the invention.

FIG. 3 shows, also in plan, hull assembly 300 of the invention. Here and in subsequent views of this embodiment reference numerals for corresponding parts or features are increased by another hundred (i.e., the same two digits preceded by 3, instead of 1 or 2). This third embodiment differs from the previous two embodiments by having two hull envelope pairs spaced apart by longitudinal gap 305. Hull envelopes 313 and 314 constitute the port pair, and envelopes 316 and 317 constitute the starboard pair.

Figure 4:
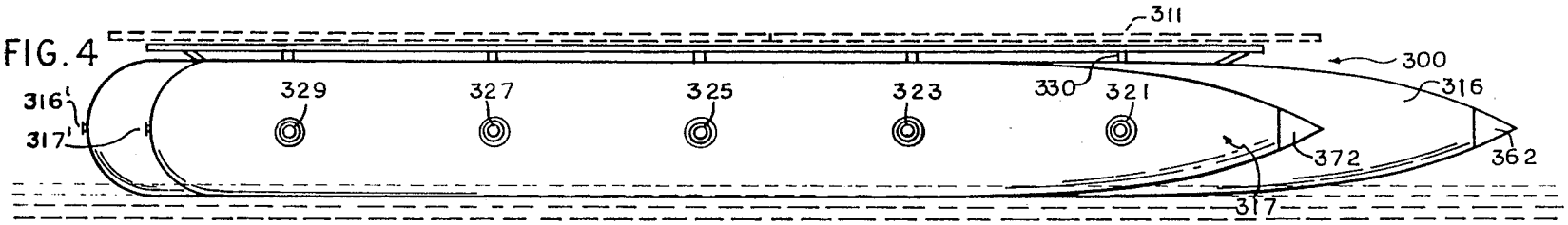
FIG. 4 is a side elevation of the hull assembly embodiment of the last view, corresponding in outline to any of the embodiments.

FIG. 4 shows, in side elevation, the hull assembly of FIG. 3. Actually, each of the embodiments might appear identical viewed in such direction, but here the reference numerals of FIG. 3 are used. Dashed lines superimposed below and on the lower part of the hull assembly signify water, which the vessel floats in and is adapted to traverse. Decking 311 is seen to be carried on supports 330, just barely visible protruding above the hull envelopes. Details of the framework, of which the supports are part, appear in the next several views.

Figure 5:
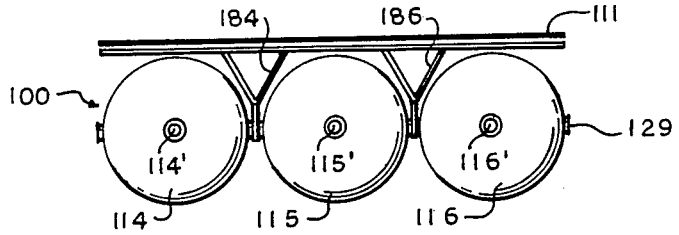
FIG. 5 is a rear elevation of the hull assembly of FIG. 1.

FIG. 5 shows, in rear elevation, hull assembly 100 of FIG. 1, with decking 111 shown in solid. Also shown are generally Y-shaped framework members 184 and 186, upon which the decking is supported via one or more transverse topping members. Later views show how the framework is supported via the tie members, of which only the ends of one member (129) appear here.

Figure 6:
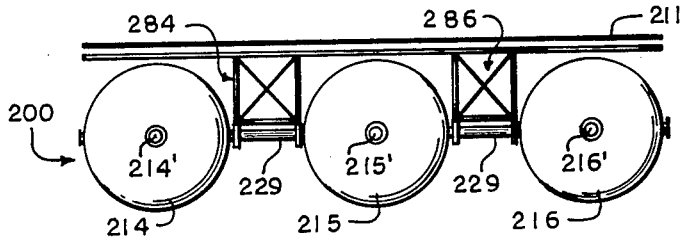
FIG. 6 is a rear elevation of the hull assembly of FIG. 2.

FIG. 6 shows, in rear elevation, hull assembly 200 of FIG. 2, with decking 211 shown in solid. Also shown are framework members 284 and 286, in generally rectangular cross-braced form, supporting the decking. Tie member 229 is visible passing through the frame members in the gaps between adjacent hull envelopes; details of their interconnection appear in later views and are described accordingly.

Figure 7:
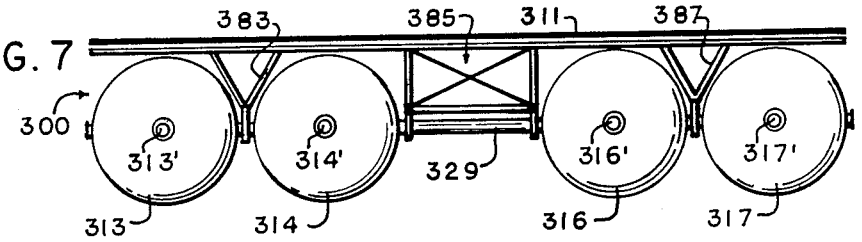
FIG. 7 is a rear elevation of the hull assembly of FIG. 3.

FIG. 7 shows, in rear elevation, hull assembly 300 of FIG. 3, with decking 311 shown in solid. Central framework member 385, in generally rectangular cross-braced form, is shown between flanking pairs of hull envelopes (313, 314 and 316, 317), whereas generally triangular framework members 383 and 387 are within the respective hull pairs. This framework also appears in further detail later.

Figure 8:
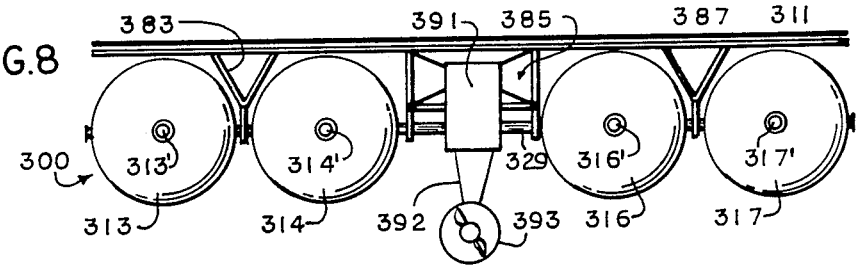
FIG. 8 is a rear elevation of the third embodiment similar to FIG. 7 but with the addition of propulsion means in the form of an outboard engine.

FIG. 8 shows, in rear elevation, the last shown hull assembly with addition of outboard motor assembly supported by central frame member 385 and including motor housing 391, drive shaft housing 392, and screw propellor 393.

Figure 9:
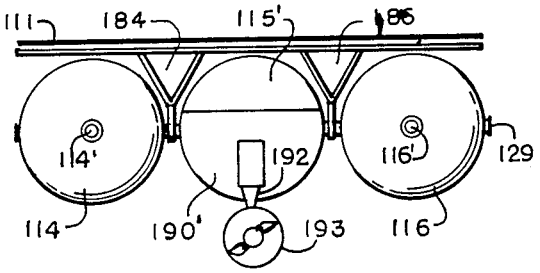
FIG. 9 is a rear elevation of the first embodiment similar to FIG. 5 but with the addition of propulsion means in the form of an inboard engine.

FIG. 9 shows, in rear elevation, first shown hull assembly 100, with modified central hull envelope 115' backed up with engine well 190 (shown in further detail in subsequent views), within which the engine assembly itself is concealed, only drive shaft housing 192 and screw propellor 193 being visible aft of the engine well.

Figure 10:
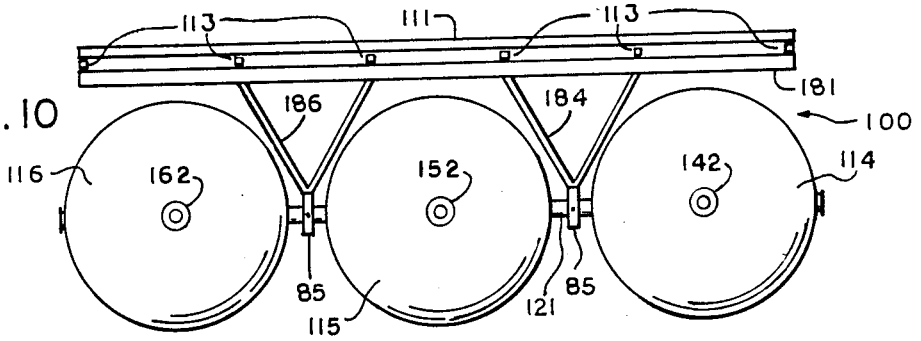
FIG. 10 is a rear elevation of the hull assembly of FIGS. 1 and 5, on an enlarged scale.

FIG. 10 shows, in front elevation, first hull assembly 100 on an enlarged scale. Visible members of framework 180 include two Y members (184 and 186) much as shown in FIGS. 5 and 9, here topped by single transverse member 181 of the framework. Tie member 121, whose ends are barely visible, is also slightly visible between the hull envelopes, where it passes through vertical hub 85 of each such Y member. Decking 111 is spaced slightly above transverse frame member 181 by intervening central and side longitudinal box strips 113.

Figure 11:
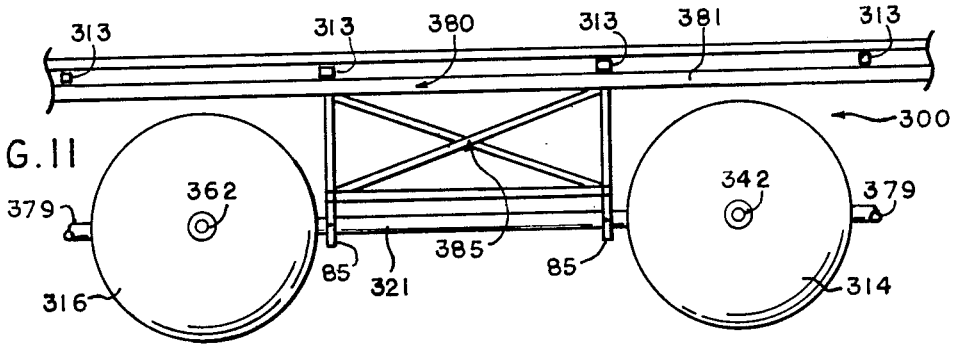
FIG. 11 is a similarly enlarged rear elevation of the hull assembly of FIGS. 3 and 7.

FIG. 11 is a similarly enlarged front elevation of second hull assembly 200, whose framework 380 comprises spaced pair of vertical members rising from hubs 85 and being interconnected by X bracing and topped by transverse frame member 381. Tie member 321 is seen traversing the space (305) between hull envelopes 314 and 316 as well as the vertical hubs. The two outermost envelopes (313 and 317) are omitted from this view, and the tie member is cut away at each end accordingly, because of space limitations.

Figure 12:
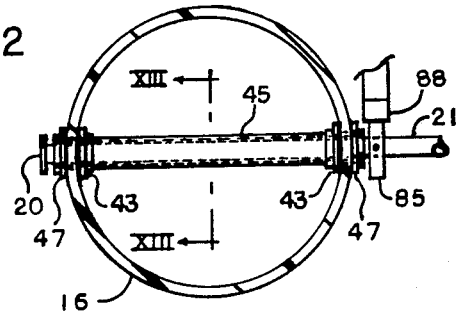
FIG. 12 is a transverse sectional elevation through a hull envelope along one of the transecting tie members.

FIG. 12 is a transverse sectional elevation, showing in detail typical relationship of a hull envelope, a transecting tie member, and the framework—as at the leftmost portion of FIG. 10 or other comparable location in a hull assembly of this invention. Hull envelope 16 (designated by only two digits to indicate its use in any embodiment of hull assembly) has diametral horizontal sleeve 45 therethrough open at its ends and transected by tie member 21, so designated—without prefixed hundreds digit—to indicate general utility as tie member 121, 221, 321 (or others) of the illustrated embodiments or in an equivalent structure not so exemplified. Interior flanges 43 and exterior flanges 47 reinforce the junction of the envelope and the sleeve to preclude leakage of air out of (or water into) the envelope. Plug cap 20 terminates the leftmost end of the tie member. It will be apparent that this sectional view may be taken as exemplifying most of the left part of FIG. 10.

Figure 13:
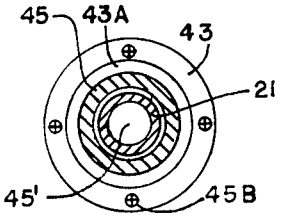
FIG. 13 is a sectional elevation taken at XIII—XIII on FIG. 12.

FIG. 13 shows, on an enlarged scale, a section perpendicularly through sleeve 45 and tie member 21 viewed along their common axis from inside hull envelope 16, as indicated at XIII—XIII on FIG. 12. Wall thicknesses are exaggerated here in the interest of clarity, where the components are all concentric circles, some being shaded. Interior flange 43 is visible as the unshaded annular space between the two outermost circles; the adjacent narrower unshaded annulus represents the inwardly facing edge of flange hub 43A. Bolts or screws 45B through the flange appear head-on. Sleeve 45 is the next annular ring, which is shaded for metallic composition, and tie member 21 shows as a thicker similarly shaded ring therewithin. Blank circular space 45' about the center indicates that this tie member has a tubular rather than an alternative solid construction. It will be understood that exterior flange 47 (not visible here) and the visible interior flange grip an intervening portion of hull envelope 16 tightly between them and thereby seal the interior of the hull envelope from the exterior.

Figure 14:
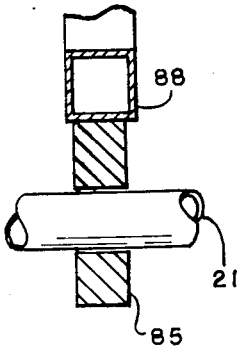
FIG. 14 is a further enlarged elevation of hub detail from the right side of FIG. 12 viewed in the same end direction.

FIG. 14 shows, in sectional elevation the rightmost or hub portion of FIG. 12. At its top, hub 85 adjoins longitudinally extending box member 88 at the bottom of a vertically extending (unnumbered) framework member, whose upper portion is simply not shown—but which could be part of triangular framework as in the first and third hull assembly embodiments, or rectangular as in the second and third embodiments, or any similarly suitable structure.

Figure 15:
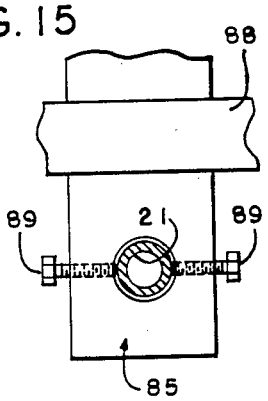
FIG. 15 is a side elevation of the same hub detail viewed in a horizontal direction perpendicular to FIG. 13.

FIG. 15 shows hub 85 of the preceding views in end elevation, with tie member 29 sectioned accordingly and passing through a close-fitting bore (unnumbered) in the hub. The hub is also bored perpendicularly to and intersecting such close-fitting bore and is threaded to receive pair of bolts 89 therein from opposite sides to pinch the outside of the tie member between them and thereby to assist in affixing the framework to the tie member.

Figure 15A:
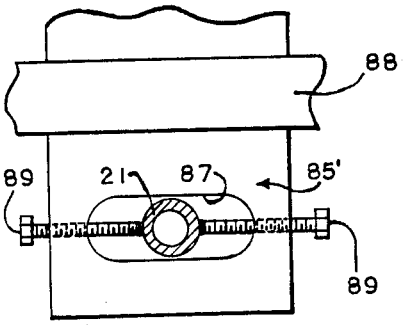
FIG. 15A is a view, similar to FIG. 14, of an alternative hub.

FIG. 15A shows in like manner modified hub 85', whose bore 87 for receiving a tie member (21) is elongated sideways to accommodate minor fore-and-aft misalignment of the respective members. Again, the tie member is pinched between pair of bolts 89, here shown in solid lines within bore 87 as well as in broken lines within the threaded bore.

Figure 16:
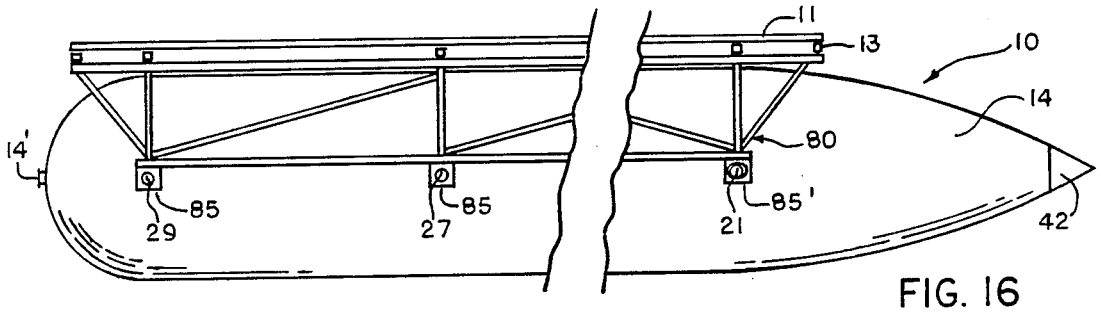
FIG. 16 is a side elevation of a hull assembly sectioned between hull envelopes.

FIG. 16 shows the hull assembly of an aquatic vessel of the present invention in longitudinal section alongside a hull member and through the framework hub locations. As this illustration is representative of a like view through any exemplified embodiment, counterparts here (and in succeeding diagrams) of parts that are uniquely referenced in any such embodiment have shortened two-digit reference numerals, whereas elements without such counterpart have one-digit reference numerals, to indicate their general utility. Truss-braced framework 80 receives tie members 27 and 29 through aft hubs 85, and receives forwardmost tie member through hub 85'. Most of the intervening assembly is cut away to conserve space here and in later views. The tie members transect hull envelope 14 (as well as at least one adjacent envelope, not visible here) and so support framework 80, also decking 11 via intervening transverse members 13.

Figure 17:
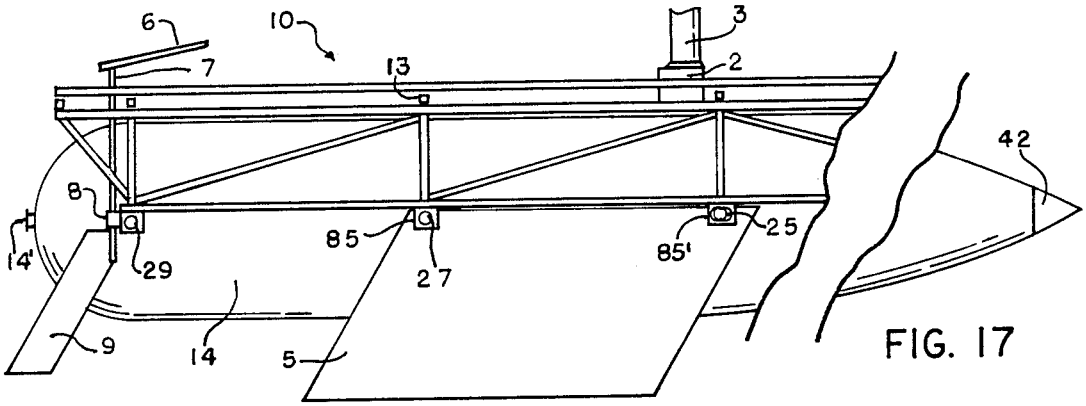
FIG. 17 is a side elevation of a hull assembly similar to FIG. 16 but with the addition of a mast step, keel, and rudder.

FIG. 17 is similar to FIG. 16 but cut away further forward and plus optional elements especially suited to wind-propulsion of the vessel. Thus, mast step 2, with base of mast 3 therein, is shown mounted on the top part of the framework overlying keel 5, which is supported on the underside of the framework in the vicinity of the third hub (85') and the fourth hub (85), counting from the bow. Tiller 6 is at the top of rudder shaft 7, which is journaled in fitting 8 affixed to the framework, in the vicinity of aft hub 85, and is thereby adapted to adjust the orientation of rudder 9. Such a vessel is especially suited to wind propulsion wholly or partly.

Figure 18:
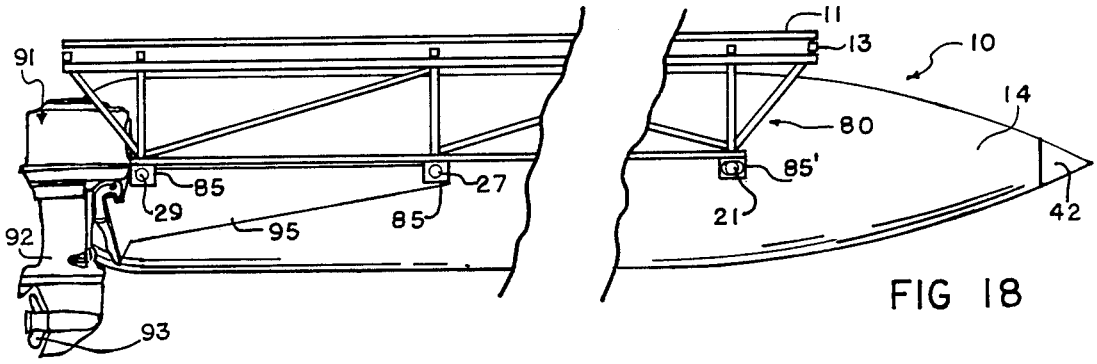
FIG. 18 is a side elevation of a hull assembly similar to FIG. 16 but with the addition of an outboard engine.

FIG. 18 differs from FIG. 16 only in being equipped for power propulsion, specifically by means of outboard motor assembly 91 supported on bracket 95 attached to the framework in the vicinity of aft hubs 85 and having screw propellor 93 driven through means in intervening housing 92.

Figure 19:
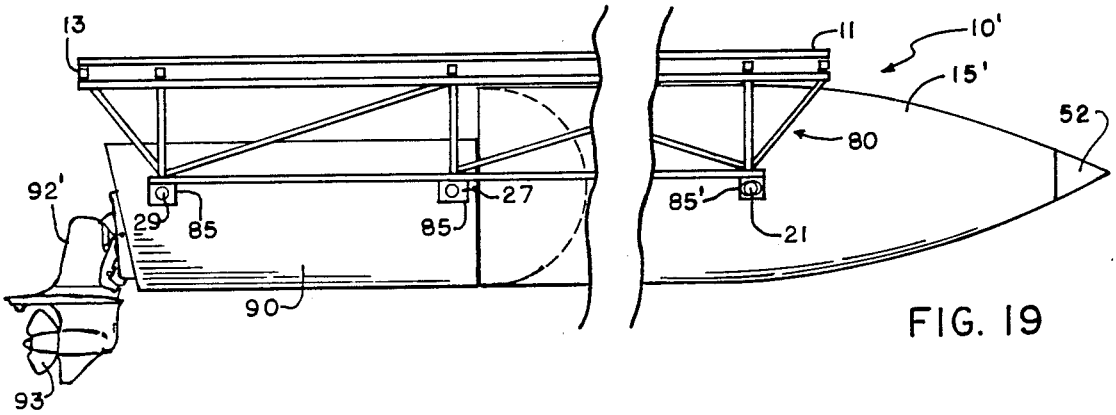
FIG. 19 is a side elevation of a hull assembly similar to FIG. 16 but with the addition of an inboard engine.

FIG. 19 shows modified hull assembly 10' whose hull envelope 15' is truncated and concave at the rear to receive engine well 90, which also is transected by tie members 27, 29 through aft hubs 85. Screw propellor 93 is driven from an engine concealed in the well by means hidden by intervening housing 92'—a bit different from the corresponding outboard feature in the preceding view.

Figure 20:
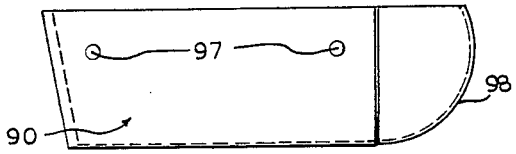
FIG. 20 is a side elevation of an engine well, adapted to fit into an appropriately concave modified hull envelope.

FIG. 20 shows engine well 90 in side elevation, apart from the hull assembly. It somewhat resembles a conventional form of baby basket or carriage, having a generally rectangular body portion and head portion 98 convex in elevation (though not extending overhead). It also has transverse openings 97 to receive two tie members.

Figure 21:
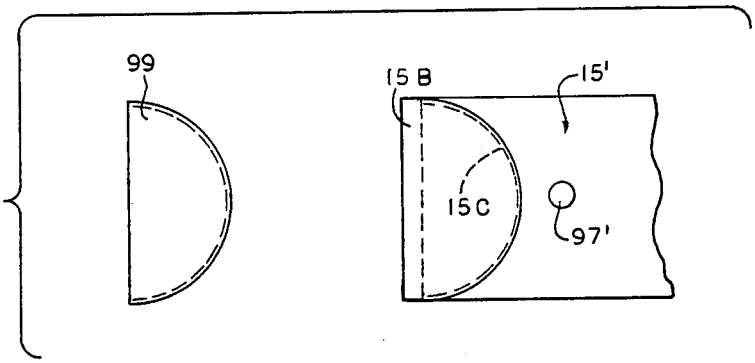
FIG. 21 is an exploded side elevation of a liner and the rear portion of a truncated hull envelope modified to receive such liner.

FIG. 21 shows, in exploded side elevation, hemispherical hull-reinforcing compression member 99 at the left, and at the right the aft end of truncated hull envelope 15' with concavity 15C into which the compression member fits. The compression member also fits, of course, over convex end 98 of the engine well (illustrated in the preceding view), as shown further in the next view.

Figure 22:
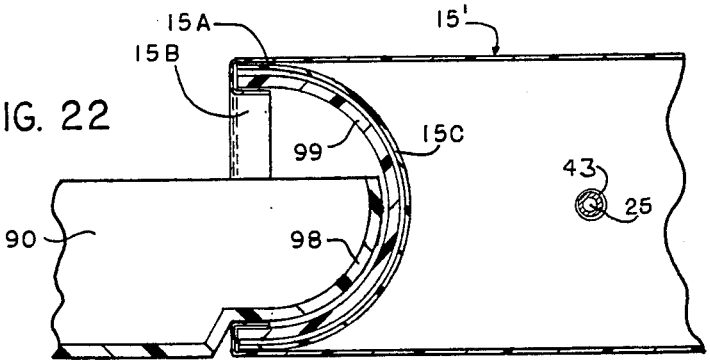
FIG. 22 is a sectional side elevation, on an enlarged scale, at the conjunction of the members of the last several views.

FIG. 22 shows, in partial longitudinal section, modified hull envelope 15' and engine well 90, separated by compression member 99. Concave end piece 15C fits within the aft end of the envelope and is sealed thereto by adhesive along strip 15A all around. The end piece is recessed within the open end of the hull envelope so as to leave part of the envelope protruding. Here resulting flap 15B is shown bent around and back over the rim of the reinforcing liner and similarly sealed to it, thereby safeguarding the hull end cap from blowing out under the hull inflation pressure and incidentally protecting the hull envelope from possible damage from activities in the engine well. Shading is for thermosetting or thermoplastic compositions. Tie member 25 (shaded for metal) is seen inside the interior flange (43) of the hull envelope sleeve (not shown).

Figure 23:
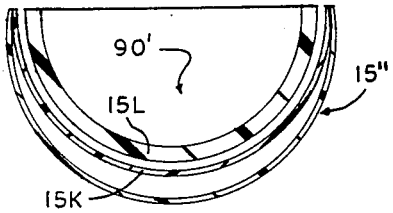
FIG. 23 is a transverse sectional elevation of a liner for an engine well, such as shown in the preceding views.

FIG. 23 shows, in transverse elevation, a portion of further modified hull envelope 15" having concave part 15K in its upper surface (instead of at an end) for cockpit structure 90' otherwise analogous to engine well 90. Generally semicylindrical compression member 15L fits flush in the concavity.

Figure 24:
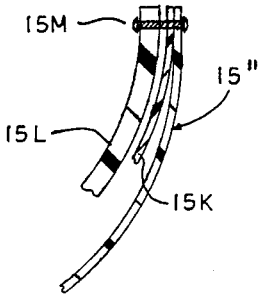
FIG. 24 is a detail, on a further enlarged scale, of retaining means installed at the upper right corner of FIG. 23.

FIG. 24 is a similar sectional detail of one edge of the modified structure shown in FIG. 23. One of a series of bolts or rivets 15M illustrates satisfactory securing means. Of course, both adhesive and mechanical joining means may be used here or in the structure of the preceding view for enhanced security against such undesirable occurrences as leaks or other physical separation.

Figure 25:
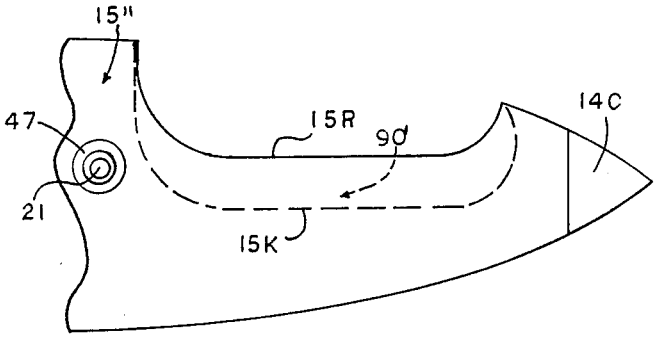
FIG. 25 is a side elevation of the prow of an aquatic vessel of this invention, with a cockpit therein shown in broken lines.

FIG. 25 is a fragmentary side elevation of the forward end of further modified hull envelope 15" in the vicinity of the portion shown in the last two preceding views. Cockpit concavity 15K is indicated in part by a dashed line and in part by visible recessing of the envelope sidewalls at 15R. The tapered nose portion may or may not be partially recessed for such purpose aft of nose cone 14C, so its inner structure is not shown here but is analogous to and is understandable from the presentation of nose cone construction according to this invention in the final diagram.

Figure 26:
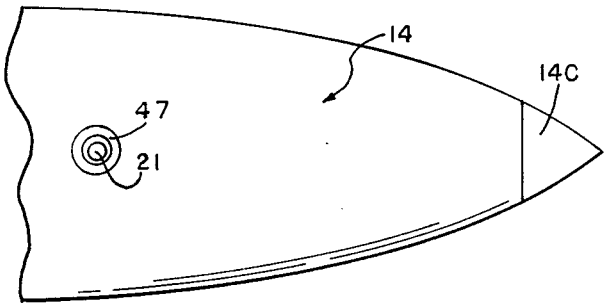
FIG. 26 is a fragmentary side elevation of an inflatable hull envelope of the invention, with added nose cone.

FIG. 26 shows the pointed forward end of representative hull envelope 14 having distinguishable nose cone 14C. The forwardmost exterior flange 47 and transecting tie member 21 are at the left, as they were in the immediately preceding view.

Figure 27:
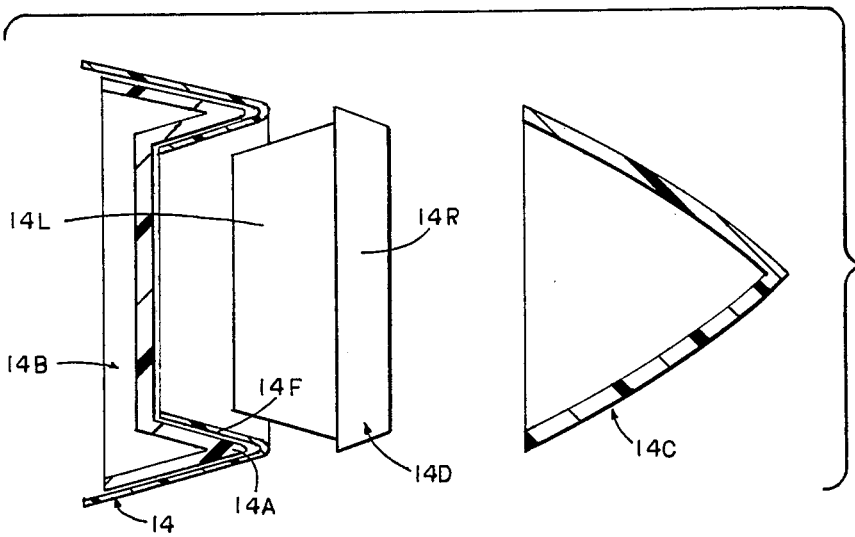
FIG. 27 is a partially exploded side elevation of such a nose cone assembly.

FIG. 27 shows in partially exploded axial section the hull structure at the junction of hull envelope 14 and nose cone 14C (shown partly cut away). The frustoconical forward end of the envelope is folded as flap 14F back inward around acute-angled rim 14A of cylindrical insert 14B. Doubly frustoconical plug 14D, shaped somewhat like a barrel truncated at both ends, fits at its left end 14L within the rim of the cylindrical insert, and at its right end 14R within the open base end of the nose cone.

The illustration of a pointed nose cone is not intended to preclude use of alternatively shaped nose cones on hull envelopes or omission of nose cones altogether, as rounded ends may indeed be preferred in some uses of such aquatic vessels. Conversely, the aft ends of hull envelopes (shown rounded in the diagrams) may be equipped with tail cones similar to or different from nose cones.

It will be understood that vessels having hull assemblies according to this invention may have numerous additional features as well, supported by the framework, such as superstructure with or without accommodations for crew and passengers, and recreational equipment such as winch and cable for use in pulling water-skiers or parasailers, outfitted for whatever means of propulsion may be desired, including not only those already shown but engine-driven air propellors, air or water jet-propulsion means, etc. Suitable propulsion means will drive such a vessel at upwards of gale speed, or about 50 knots. The inflatable structure, although it may seem more fragile than rigid hulls, is better able to withstand waves, vibration, and sudden shocks—apparently because the inflated hull envelopes absorb and damp out movements that would break apart or crush wholly rigid structures. Indeed, the dynamics of inflatable aquatic vessels constructed according to this invention cannot be appreciated without having being aboard such a vessel.

It will be understood that the flexible envelopes may be composed of a wide range of elastomeric and polymeric materials, with or without added reinforcement such as fibers, filaments, or fabrics of like or unlike composition. Glass textiles are common reinforcing materials. Examples of suitable envelope compositions include synthetic rubber such as butadiene, also hydrocarbons such as polyethylene and polypropylene, polyvinyl chloride, and fiber- and film-forming polyamides such as nylon, also aromatic polyamides or aramides, and polyesters such as polyethylene terephthalate, for example. Polyurethane is an example of an often preferred hull envelope composition. As no particular composition is essential to construction of the envelopes, the designer or builder of inflatables has indeed a broad range of materials to choose from, and may choose according to cost, environment, stressing, utility, and other factors.

The sleeves and their flanges and the tie members may, but need not, be made of the same or similar materials as the flexible envelopes, and may vary considerably therefrom in their physical characteristics, whether made of similar or different materials. The sleeves and flanges may be of similar composition, especially if desired to be flexible, and for more nearly rigid construction polyvinyl chloride is a good choice of polymeric material. Other similarly suitable materials include metals, such as aluminum or stainless steel, and even wood may be used if desired. Whereas the envelope material may be on the order of a millimeter or two thick, flanges and tubular tie members usually have greater wall thickness (such as a few millimeters to as much as several centimeters) and usually are ten or more centimeters in diameter—as are rodlike tie members. Flanges may be bonded to sleeves adhesively or by fusion, welding or other suitable method depending upon composition.

Composition selection and the dimensional and other physical specifications for the envelopes, the flanges, the sleeves, and the tie members, depend principally upon the usage contemplated, such as the size of the resulting assembly and the external stresses to which it is expected to be exposed. Thus, a small assembly of lightweight envelopes for use under sail for coastal fishing may well accommodate smaller or weaker components than are desirable in a larger assembly designed for ocean use under motor propulsion. Experienced sailors will have less difficulty than landlubbers in judging the appropriateness of various component materials, and all who use such assemblies will likely learn from actual experience.

Air is the most common inflatant, but carbon dioxide, nitrogen, or other gases may be used where non-combustibility is especially important. Relatively low inflation pressure, such as one-tenth kilogram per square centimeter (approximately one and one-half pounds per square inch) is adequate to induce a satisfactorily high skin tension in the hull envelopes. Water or other liquid may be substituted in part, for whatever reason, as when an intermediate or high density is desired, perhaps for operations on land or under water. Each envelope may contain one or a plurality of compartments.

It should be apparent from the previous description that the assemblies of this invention are easy to set up and to take down, as well as to ship disassembled. Especially when deflated, the individual envelopes, along with their built-in sleeves, and the tie members can be carried piece-by-piece readily enough by one or several people.

It may be desirable for the sleeves to be made flexible enough that fully inflated envelopes constrict the sleeves sufficiently to grip irremovably the tie members inside. In that event it may be less important to provide retaining means on or for tie members, although caps bonded or screwed on or plugs inserted therein may be desirable to seal them or provide a slot or tiepoint for rope, etc. Alternatively, it may be preferable to use relatively rigid sleeve material, so that the tie members (also relatively rigid) can be readily inserted and also be withdrawn at or near full inflation. Instead of bolts or screws already shown and described (or some equivalent hub-retaining means), fasteners or knobs on the ends of the tie members, or covers over the open sleeve ends, may be used.

The number of inflatable hull envelopes may be increased. Thus, a pair of inflatable hull envelopes may be added to flank the three envelopes of either the first embodiment or the second embodiment, and may be either mutually adjacent thereto or spaced therefrom in either instance. An additional pair of inflatable hull envelopes may flank the spaced pairs of such envelopes in the third embodiment, whether adjacent thereto or spaced therefrom. Also, similar inflatable hull envelopes may be added ahead of or behind hull envelopes (or spaces therebetween) or both fore and aft thereof.

Modifications or variants of the exemplified embodiments have been suggested above, and other possible assemblies may come to mind that utilize the present method and means of structuring inflatables. Others may include adding, combining, subdividing, or deleting parts or steps, yet retaining some or many of the advantages and benefits of this invention, which itself is defined in the following claims.

The claimed invention:

1. An aquatic vessel having a plurality of hull members,
- each such hull member comprising an inflatable envelope,
- each such envelope having a plurality of open-ended sleeve members transecting it,
- each such sleeve member being sealed at its ends to the walls of the envelope and thereby sealing off the envelope from the exterior,
- a plurality of tie members, and
- rigid framework adapted to receive and attach to the tie members,
- assembled according to the method comprising the steps of
- inserting the tie members through such framework and through such sleeve members,
  - each of such tie members transecting sleeve members in a plurality of such envelopes, and
- attaching such framework to such tie members between adjacent hull members.

2. Aquatic vessel assembled according to the method of claim 1, including inflating such envelopes before inserting such tie members through the sleeves of the envelopes.

3. Aquatic vessel assembled according to the method of claim 1, including inflating such envelopes after inserting such tie members through the sleeves of the envelopes and out the opposite ends.

4. Aquatic vessel assembled according to the method of claim 3, wherein the sleeves are flexible, and including gripping the tie members laterally with the sleeves as the envelopes expand upon being inflated, thereby securing the hull members together.

5. Aquatic vessel assembled according to the method of claim 1, wherein such framework includes laterally spaced hubs alongside such inflatable envelopes and aligned with such sleeves, and including inserting the tie members through the hubs as well as the sleeves.

6. Aquatic vessel assembly method according to the method of claim 1, wherein such framework includes laterally spaced hubs aligned with such sleeves, and including the step of securing the hubs to the tie members.

7. Aquatic vessel assembled according to the method of claim 5, wherein the sleeves are inflexible, and the framework hubs include adjustable attaching means, and adjusting the attaching means to secure the hull members together.

8. Aquatic vessel assembly method, comprising
- inserting a central inflatable hull member inside cage-like framework means having laterally spaced and aligned hub members,
- flanking the central inflatable hull member with a pair of inflatable hull members,
  - each such inflatable hull member having a plurality of similarly aligned transecting sleeves,
- inserting a tie member through each set of aligned sleeves and hubs, and
- inflating the inflatable hull members with the tie members in the sleeves.

9. Aquatic vessel assembly method according to claim 8, including supporting decking via the framework.

10. Aquatic vessel assembled according to claim 8.

* * * * *